US005484380A

United States Patent [19]

Bevins

[11] Patent Number: 5,484,380

[45] Date of Patent: Jan. 16, 1996

[54] BOX HANDLING SYSTEM

[76] Inventor: Earl Bevins, 8645 17th Ave., Kenosha, Wis. 53135

[21] Appl. No.: 303,514

[22] Filed: Sep. 9, 1994

[51] Int. Cl.[6] ..... B31B 1/78

[52] U.S. Cl. ..... 493/480; 493/309; 220/1.5; 220/6

[58] Field of Search ..... 493/309, 311, 493/312, 480; 217/13, 16, 48, 43 A, 43 R; 206/600; 220/1.5, 6, 4.29

[56] References Cited

U.S. PATENT DOCUMENTS 1,212,429 1/1917 Weinstein ..... 220/6
4,300,694 11/1981 Wait et al. ..... 217/48
4,609,116 9/1986 Simms ..... 206/600
4,776,481 10/1988 Kidd ..... 220/22
4,793,507 12/1988 Delplanque ..... 493/311
5,386,919 2/1995 Long ..... 217/43 A

*Primary Examiner*—Bruce M. Kisliuk
*Assistant Examiner*—Christopher W. Day
*Attorney, Agent, or Firm*—Joseph T. Kivlin, Jr.

[57] ABSTRACT

A method for manipulating collapsable boxes which involves the use of a combination of lateral pressure and gravity to fold or collapse the box and to store it in a desired location.

4 Claims, 3 Drawing Sheets

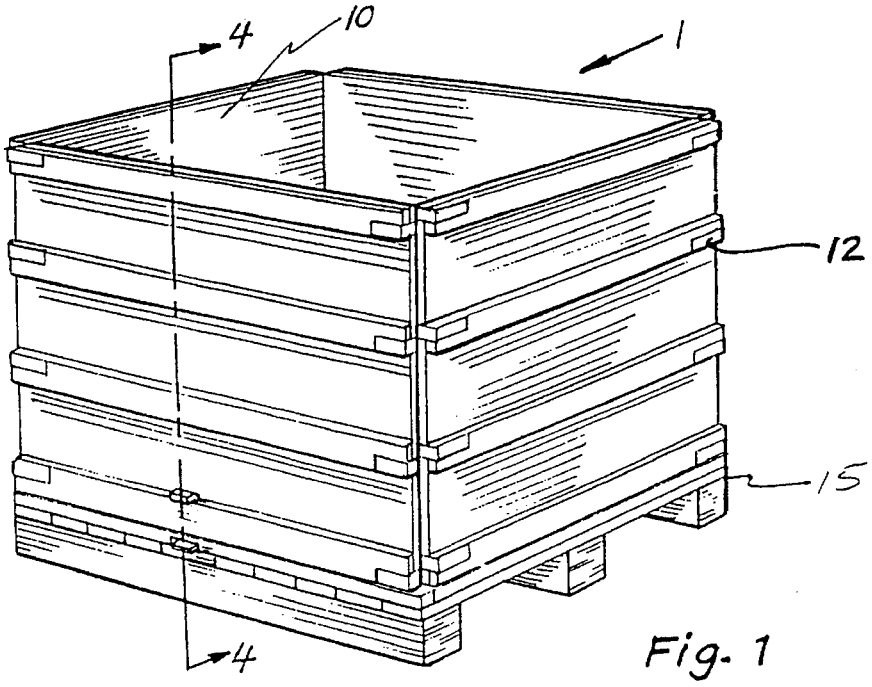
Fig. 1
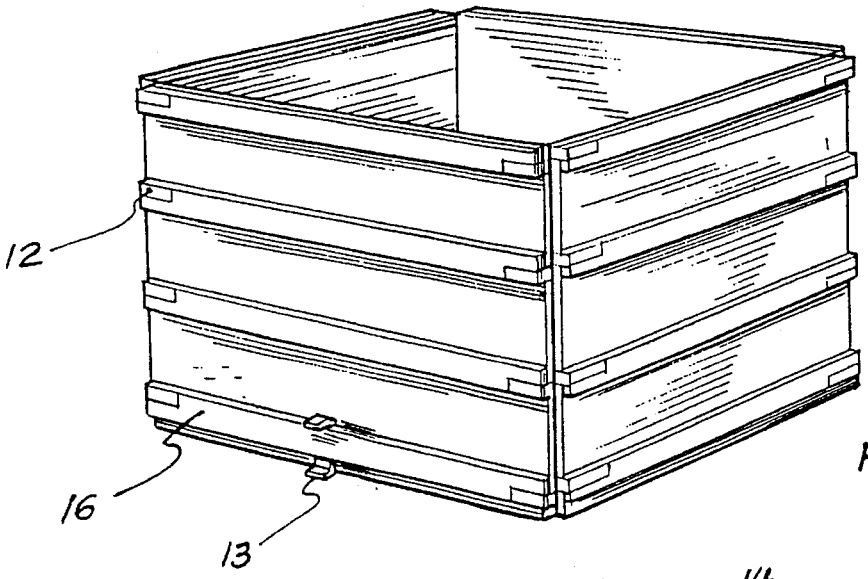
Fig. 2
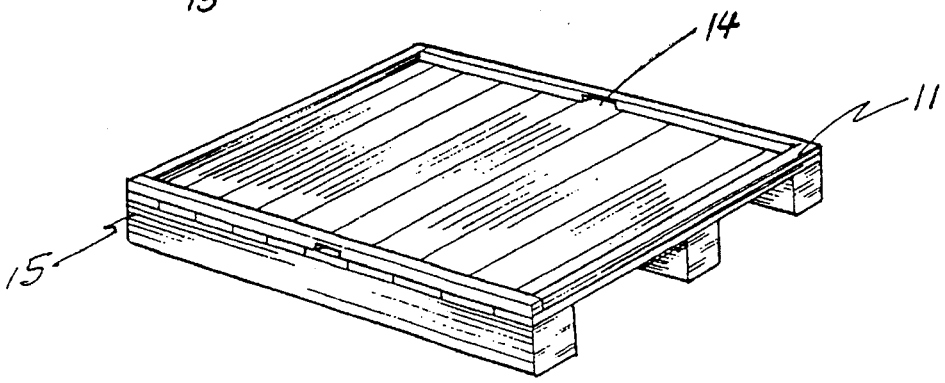

BOX HANDLING SYSTEM

BACKGROUND

This invention relates to an improved method of handling collapsible containers. More specifically, it involves the method of collapsing a box which is designed to be broken down for stacking, storing and transporting.

Certain products are suitable for being transported in boxes for further treatment. For example, some varieties of berries may be collected in large containers, before they are cleaned, sorted and packaged for retail sale. The containers used in such an operation are sometimes very large, occupying space which could be better utilized, if they could be folded and stacked. In answering this need, designs were developed for such containers, which enable such folding and stacking.

The most common containers of this kind are usually constructed of wood, having four sides and a base, and having no top cover attached. They are built with pivotable side walls, which can fold upon one another, once they are detached from the base. The base is often constructed like a wooden pallet to facilitate manipulation of the container by means of a forklift truck, especially when filled. Even when empty such containers often weigh as much as 200 pounds.

In the past, filled containers of the kind described above were moved about by means of a fork life truck, and the empty bases, which had been separated from the sides were also moved by such a truck. However, the side walls were usually collapsed and moved by hand in order to avoid any damage which might be caused by the use of a forklift. Thus, it was often necessary for two people to fold and stack the side walls, because of their awkward size and weight.

SUMMARY OF THE INVENTION

The present invention has for its object a non-manual system of manipulating collapsible topless wooden boxes. The system involves the use of a fork lift truck of the kind having a fork which is laterally pivotable as well as being tiltable forward. After emptying the contents of the box, when the latter is ready to be stored with other such boxes, the operator of the forklift can detach the side walls from the base, and stack them without any manual contact with either element of the box.

In one embodiment of such box, the sides of the box are hinged by means of two or more flexible straps, connecting each pair of side panels. When released from the bottom support, the side walls can be folded upon one another in the same manner as a paperboard box will fold, when not impeded by top or bottom elements.

In one embodiment of the present invention, the sides are attached to the bottom pallet member by a single pair of U-shaped clips, one permanently mounted on each of two opposite sides, and detachably mounted on the base. The clips are mounted on the sidewalls in such a way that when the side is depressed inwardly with respect to the base, the clip disengages from the base, but not from the wall, and is available to be reattached to a base when another container must be assembled for use.

BRIEF DESCRIPTION OF THE DRAWINGS

FIG. 1 is a prospective view showing an assembled box, the method of handling of which is the subject of this invention;

FIG. 2, also a perspective, shows the two principal elements of the box of FIG. 1 in a disassembled relationship;

DETAILED DESCRIPTION

Figure 3:
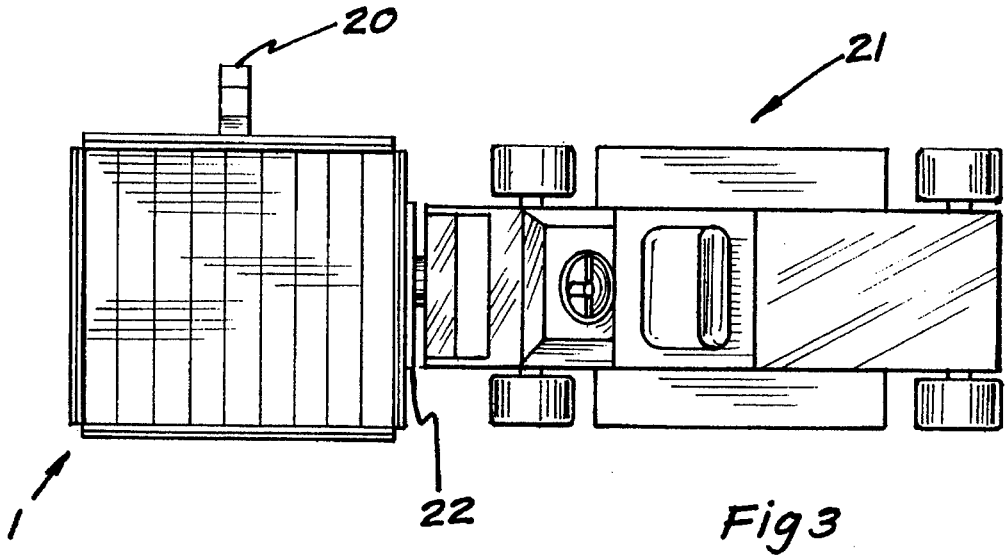
FIG. 3 is a top elevation showing the box carried on a fork lift truck with one side of the box abutting the backing of the fork of the truck.
Figure 5:
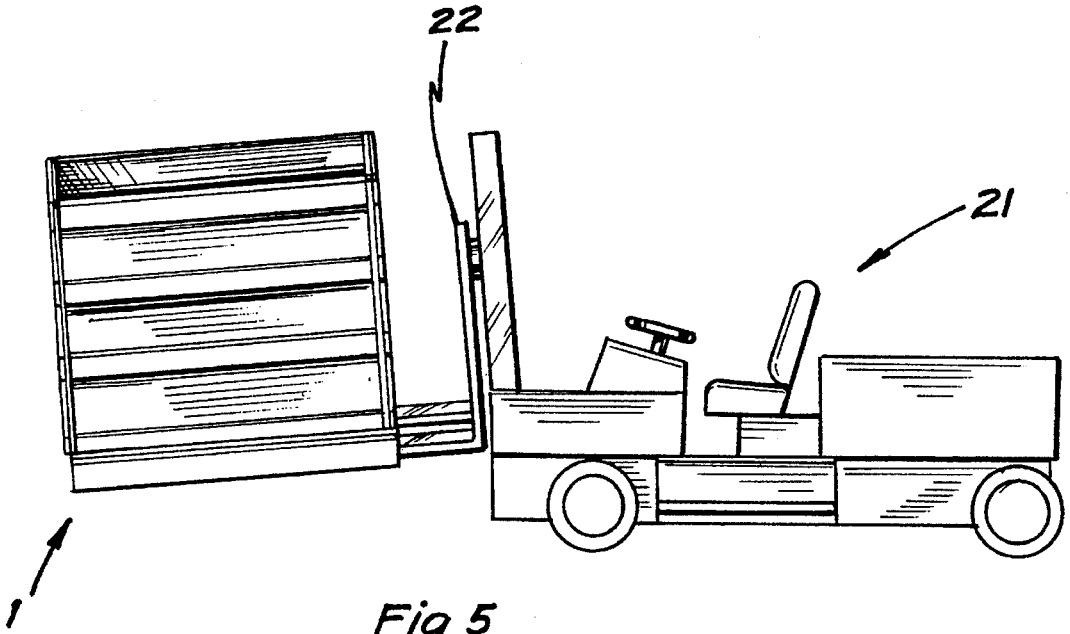
FIG. 5 is a side elevation, showing the box carried on a forklift truck, with the forks tilted forward and rotated towards the viewer and with the box being separated from the backing element of the fork.
Figure 7:
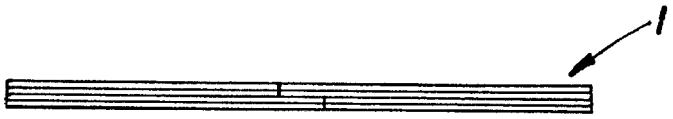
FIG. 7 shows a single box in a folded or collapsed condition.
Figure 6:
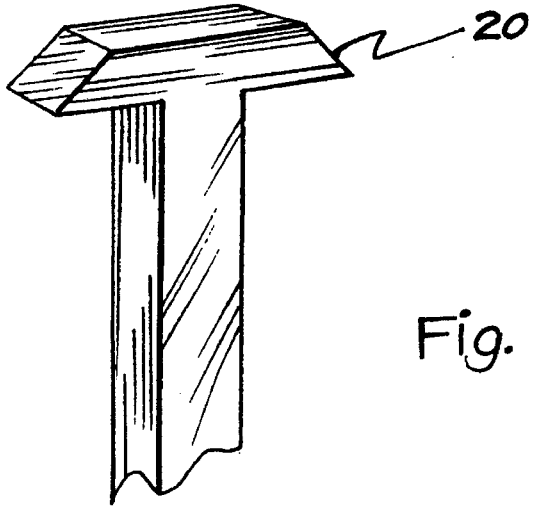
FIG. 6 shows a prong or finger element for depressing a wall of the box.
Figure 4:
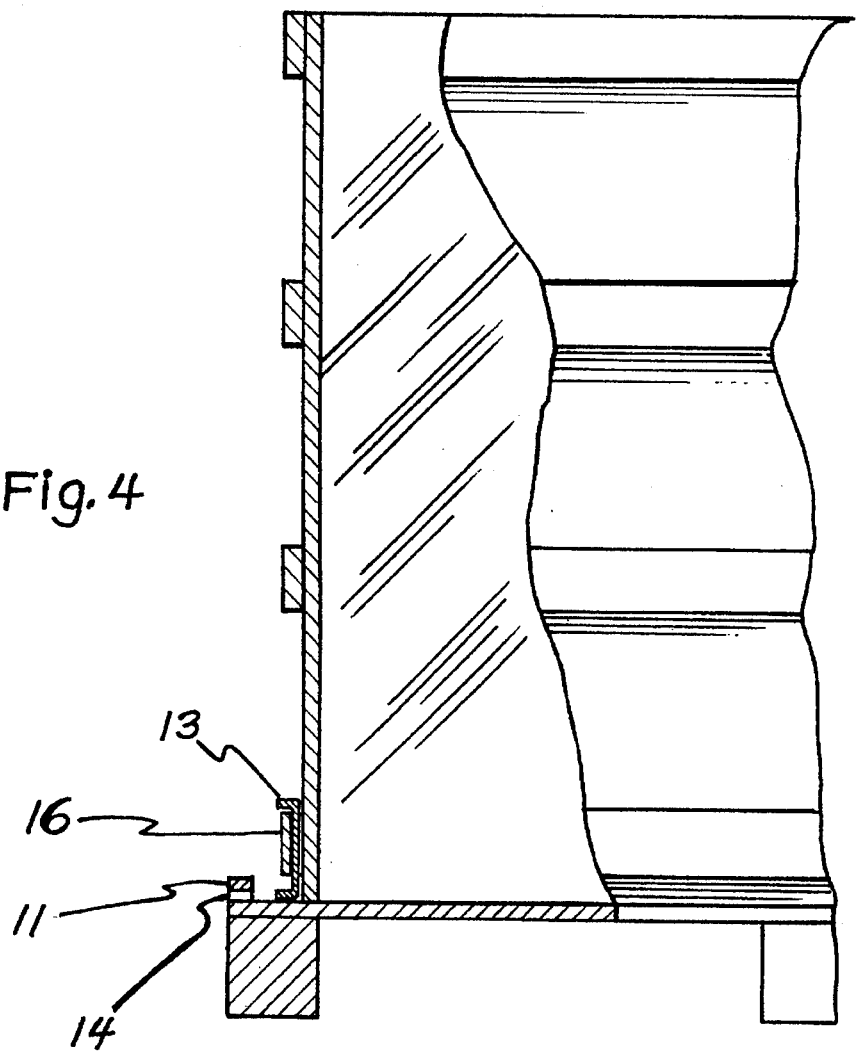
FIG. 4 is a cross sectional view taken along the line 4—4 in FIG. 1, showing the attachment clip in a disengaged relationship.

FIG. 1 of the drawings shows the assembled box generally indicated at 1. It consists of side walls 1(), which may be made of wood or plastic, attached to one another by flexible strips 12, and supported on a base or pallet 15. Pallet 15, is constructed with a frame member 11, securely attached to the periphery of its upper surface. On two opposite sides, frame member 11 has openings 14, preferably near the center of its lower side.

The collapsible walls 10, have a plurality of horizontal support members or side slats 16, with one such support being at the top of the side walls and one being located adjacent to the base thereof. On two opposite sides, the lowermost slat 16 carries a U-shaped clip 13, which is affixed to the wall by any suitable means, and having a size suitable to enable it to be inserted into opening 14, of the base.

In operation, an assembled box 1 is lifted by forklift truck 21, sufficiently for one of its sides walls 10 containing clip 13 to be pressed near its base against a finger or prong 20, to a degree to disengage one of the clips 13, from frame member 11. Thereafter, the container or box 1 which is still in an assembled position, is lowered to the floor and the forklift is backed a few inches away, sufficiently to enable tile assembled box to be lifted again, but also to permit box 1 to fall fall forward when the fork is tilted forward. Next, box 1 is lifted and the forks of the forklift are tilted forward, as well as being pivoted laterally, sufficiently that gravity causes the withdrawal of opposite clip 13 from the opening or slot 14, in the opposite side of frame member 11. As the side walls 10 become completely detached from base 11, they begin to fall and simultaneously to fold upon one another or collapse as they reach the surface upon which they are to be deposited.

It will be obvious to anyone familiar with material handling that many elements equivalent to those can be employed. For example, the U-shaped clip could be replaced by a L-shaped element permanently affixed to the side walls. Moreover it will be obvious that the prong 20, can be constructed as an element of a stacking frame, i.e. a steel frame adapted to direct the collapsed side walls so that they are deposited on a pallet in an orderly arrangement and can be easily moved by means of a forklift for truck transfer or for longer term storage.

Having described my invention, what is claimed is:

1. In a collapsible container having side walls which are pivotable with respect to one another, having no top and a detachable base, said base having a frame member at its periphery provided with an opening on two opposite sides, said base being secured to said walls by means of a pair of clips, one such clip being permanently affixed to each of a pair of opposite walls, and engaging said base through said openings; the method of manipulating said container which consists of detaching said base and collapsing said side walls by:

a. supporting such container securely in balance by means of its base on a forklift;

b. moving the container against a stationary finger element to depress one of its walls inwardly, near its clip, sufficiently to disengage said clip from said corresponding base opening;

c. moving said container away from said finger element, and moving said container forward on said forklift sufficiently to enable said container to fall forward when said fork is so tilted;

d. simultaneously tilting said container forward with respect to said forklift and laterally towards the depressed side of said container, whereby said opposite clip disengages from said base, and said walls fall to one side and forward from said forklift and collapse.

2. The method of claim 1, wherein said base is a pallet.

3. The method of claim 1, wherein said base is a pallet and said detachable clips are U-shaped.

4. The method of claim 1, wherein said container is moved forward with respect to said forklift by lowering the container to the ground and partially backing the forklift away from said container.

* * * * *